US006640373B2

(12) United States Patent
Tsai

(10) Patent No.: US 6,640,373 B2
(45) Date of Patent: Nov. 4, 2003

(54) METHOD OF MANUFACTURING A HIDDEN TYPE SHOE WITH A REPLACEABLE VAMP

(76) Inventor: Mao-Cheng Tsai, 190-12, Sec. 2, Chang-Ping Rd., Taichung (TW)

( * ) Notice: Subject to any disclaimer, the term of this patent is extended or adjusted under 35 U.S.C. 154(b) by 25 days.

(21) Appl. No.: 09/993,485

(22) Filed: Nov. 27, 2001

(65) Prior Publication Data

US 2003/0097722 A1 May 29, 2003

(51) Int. Cl.[7] ..... A43D 35/00; A43D 86/00; A43B 3/12

(52) U.S. Cl. ..... 12/142 S; 12/146 B; 12/146 BR; 12/142 T; 36/11.5

(58) Field of Search ..... 264/51, 45.1; 12/142 S, 12/146 B, 146 BR, 142 RS, 142 T; 36/11.5, 12, 25 R

(56) References Cited

U.S. PATENT DOCUMENTS 3,890,725 A * 6/1975 Lea et al. ..... 36/11.5
5,193,240 A * 3/1993 Salpietro ..... 12/146 B
5,247,741 A * 9/1993 Pastor ..... 12/142 S
5,560,877 A * 10/1996 Yung et al. ..... 264/51
5,896,684 A * 4/1999 Lin ..... 36/11.5
6,430,846 B1 * 8/2002 Lin ..... 36/11.5
2002/0174569 A1 * 11/2002 Tsai ..... 36/11.5

* cited by examiner

*Primary Examiner*—Anthony D. Stashick
(74) *Attorney, Agent, or Firm*—Birch, Stewart, Kolasch & Birch, LLP

(57) ABSTRACT

A method of manufacturing a hidden type shoe with a replaceable vamp mainly includes a plurality of seal elements disposed in advance on a lower side of an upper mold of the shoe. The seal element is engaged in advance with a female latch member before the upper mold is coupled with a lower mold. Then a foaming material is blown inside the molds to form an outsole with a sole rim formed on the periphery thereof. The female latch member is embedded in the outsole and has a vertical insert opening with an elastic teeth flap located therein. The insert opening is bordered by an outer side wall which has a jutting ring formed thereon and a through hole formed in the center thereof communicating with the insert opening for housing a latch strut. The latch strut has an outer end formed a cap end.

1 Claim, 7 Drawing Sheets

METHOD OF MANUFACTURING A HIDDEN TYPE SHOE WITH A REPLACEABLE VAMP

FIELD OF THE INVENTION

The present invention relates to a method of manufacturing a hidden type shoe with a replaceable vamp and strap and particularly a shoe that has a replaceable vamp and strap movably fastened to female latch members which have a latch strut encased in the outsole to form a neat appearance without jamming during foaming to facilitate vamp and strap replacement operation.

BACKGROUND OF THE INVENTION

Conventional methods of manufacturing shoes with replacing vamp and strap (such as the one shown in FIGS. 1 and 2) generally include forming an outsole 1. When making the outsole 1, a plurality of female latch members 2 are disposed in advance in an upper mold. A lower mold having a cavity is filled with foaming material. Then the upper mold and lower mold are coupled together to proceed blowing and foaming process to form the outsole 1. The female latch members 2 are embedded in the outsole 1 at the selected peripheral locations. Each female latch member 2 has an insert hole 3 formed on the top surface to receive and engage with a male latch member 4. The male latch member 4 is engaged with fastening lugs located at two sides of the vamp 5 or at a lower side of the strap 6. The insert hole 3 is bordered by a side wall which has a round aperture 7. Inside the insert hole 3, there is an elastic teeth flap 8 engageable with a teeth section located at the lower portion of the male latch member 4. Thus the male latch member 4 and female latch member 2 may be engaged to fasten the vamp 5 or strap 6 to the outsole 1. The vamp 5 or strap 6 also may be detached from the outsole 1 for replacement. The outer rim of the outsole 1 further has an opening 9 matching the round aperture 7 of the female latch member 2. A pushbutton 91 may be inserted in the opening 9 with one end to depress the elastic teeth flap 8 for disengaging the male latch member 4 from the female latch member to replace the vamp 5 or strap 6.

The manufacturing method set forth above is quite complicated. The forming of the opening 9 in the outer rim of the outsole 1 is especially troublesome. As the opening 9 must be matched to the round aperture 7, precise alignment is difficult. To prevent the pushbutton 91 from slipping out of the female latch member 2 after held in the round aperture 7, the pushbutton 91 must have a jutting ring 92 at the inner end to engage with the inner peripheral rim of the round aperture 7. Moreover, the pushbutton 91 also has an outer end exposed outside the opening 9 to allow people to depress with fingers. The outer end has to couple with a soft cap 93 for depressing use. Because of the jutting ring 92 at the inner end, the cap 93 cannot be integrally made with the pushbutton 91 due to molding process constraint. All this adds manufacturing difficulty and increase production cost. The resulting products also are not sightly and do not have much appealing.

SUMMARY OF THE INVENTION

The primary object of the invention to provide a method of manufacturing a hidden type shoe with a replaceable vamp. In the manufacturing process, an elastic shrouding membrane is disposed on the juncture of a latch strut and a jutting ring to effectively prevent foaming material from sticking to latch strut and allow the latch strut to be hidden inside the periphery of the outsole to become more sightly. The manufacturing method also offers a simpler process to reduce cost.

To attain the foregoing object, the method according to the invention mainly includes a plurality of seal elements disposed in advance on a lower side of an upper mold of the shoe. The seal element has a plate located on the top side thereof and an insert blade located on a lower side and are interposed by a rectangular seal block therebetween. The seal element is matched in advance with a female latch member before the upper mold is coupled with a lower mold. Then a foaming material is blowing inside the molds to form an outsole with a sole rim formed on the periphery thereof. The female latch member is embedded in the outsole and has a vertical insert opening with an elastic teeth flap located therein. The insert opening is bordered by an outer sidewall which has a jutting ring formed thereon. The jutting ring has an annular indented neck and a through hole formed in the center thereof communicating with the insert opening for housing a latch strut. The latch strut has an outer end formed a cap end. Before the upper and lower molds are coupled, the cap end and the jutting ring are covered by a resilient shrouding membrane so that foaming material won't stick to the latch strut and cap end during foaming and blowing processes. The cap end further may be located close to the outer periphery of the outsole for user to depress the elastic teeth flap in the female latch member for disengaging male latch members located at the lower sides of the vamp or strap thereby to facilitate replacement of the vamp and strap.

The foregoing, as well as additional objects, features and advantages of the invention will be more readily apparent from the following detailed description, which proceeds with reference to the accompanying drawings.

DETAILED DESCRIPTION OF THE INVENTION

Figure 1:
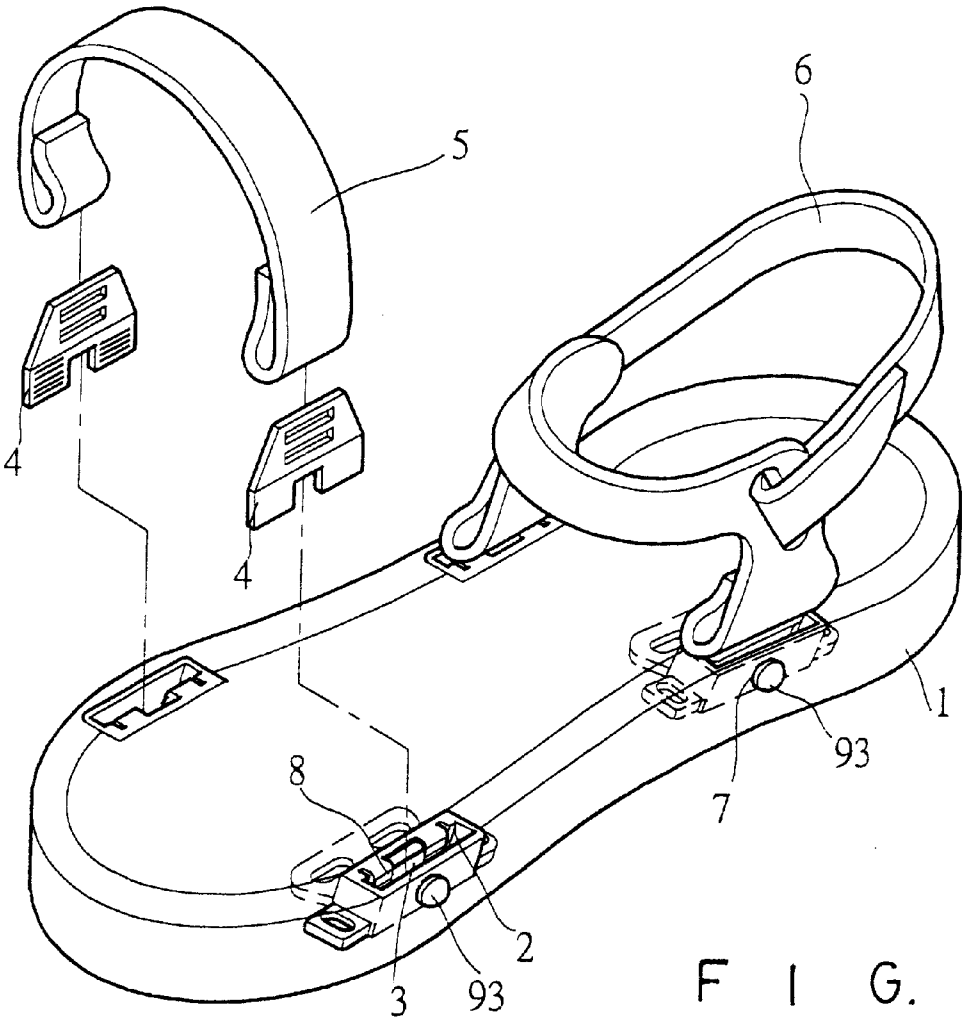
FIG. 1 PRIOR ART
FIG. 1 is an exploded view of a shoe with replaceable vamp and strap made by a conventional method.
Figure 2:
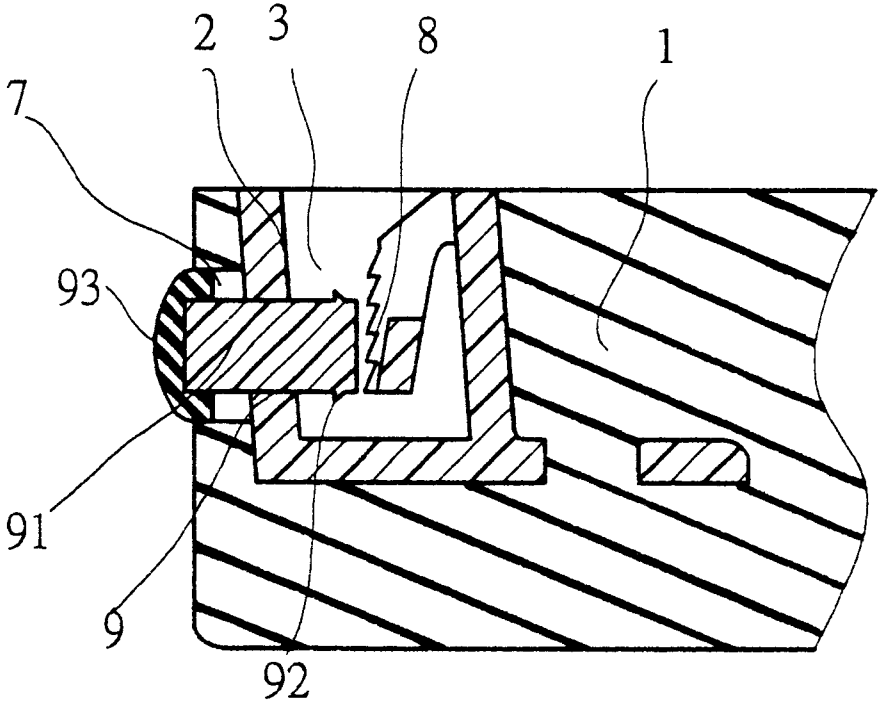
FIG. 2 PRIOR ART
FIG. 2 is a fragmentary sectional view of a conventional shoe with replaceable vamp and strap.
Figure 3:
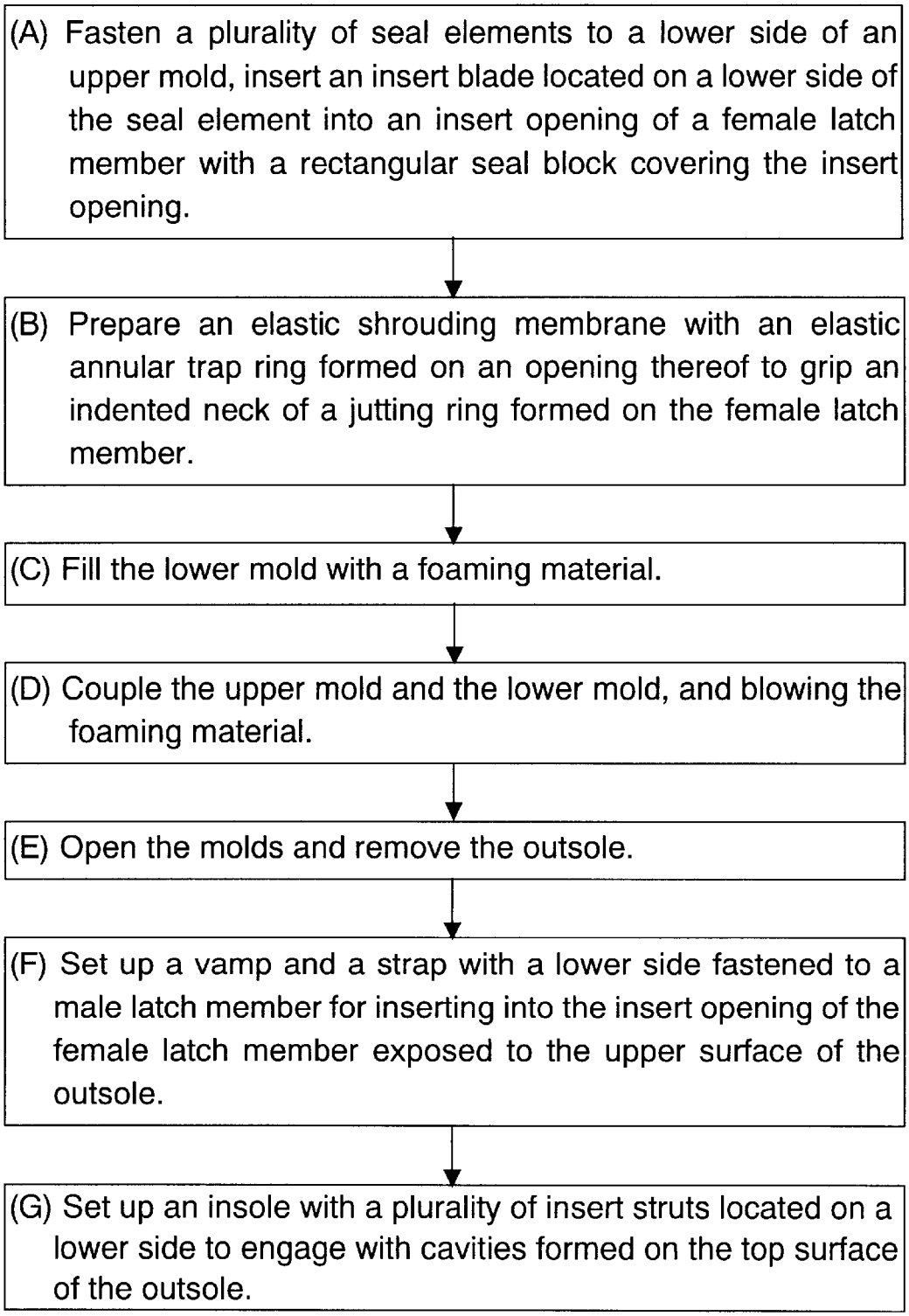
FIG. 3 is a process flow of the method of the invention.
Figure 4:
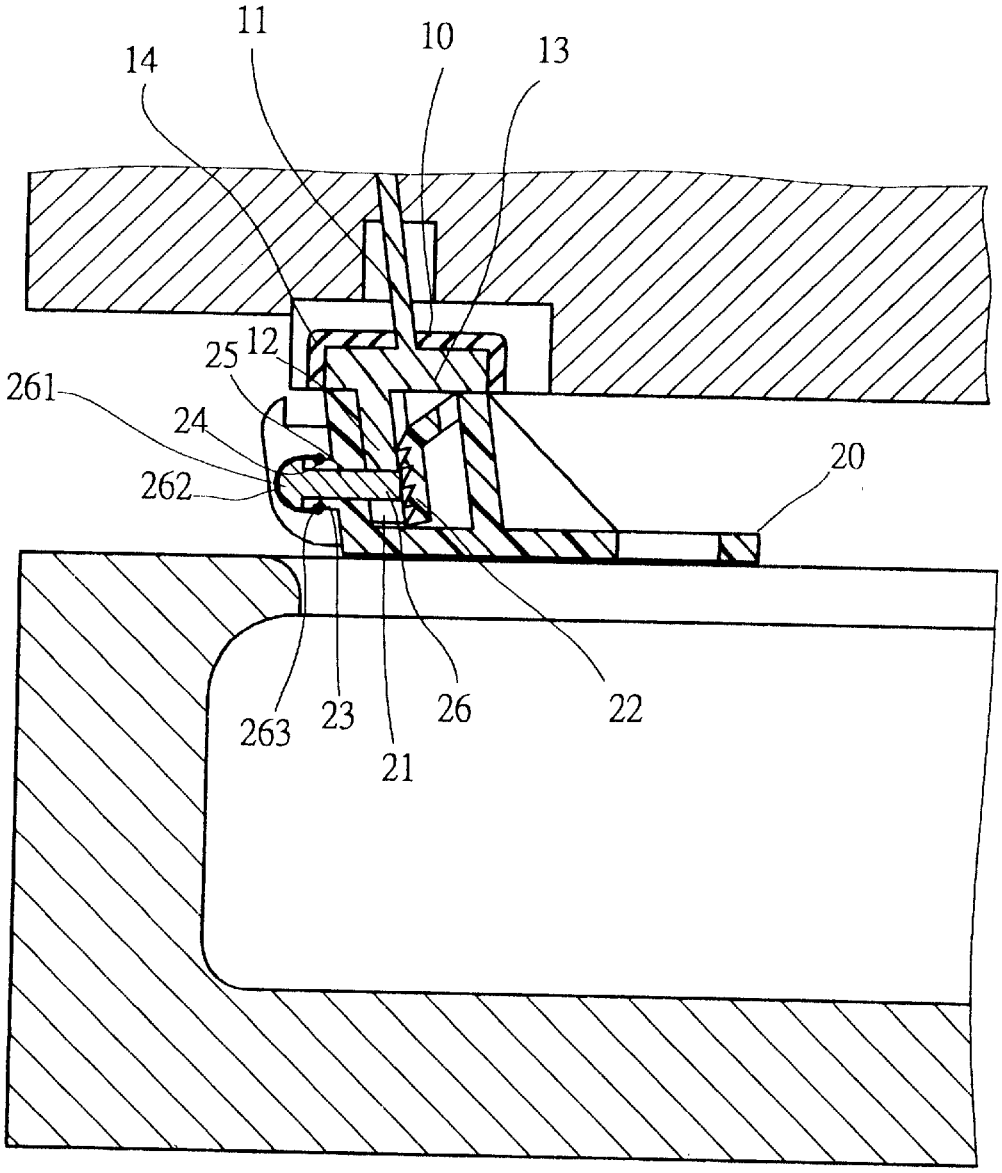
FIG. 4 is a fragmentary sectional view of an upper and a lower mold of the invention.
Figure 6A:
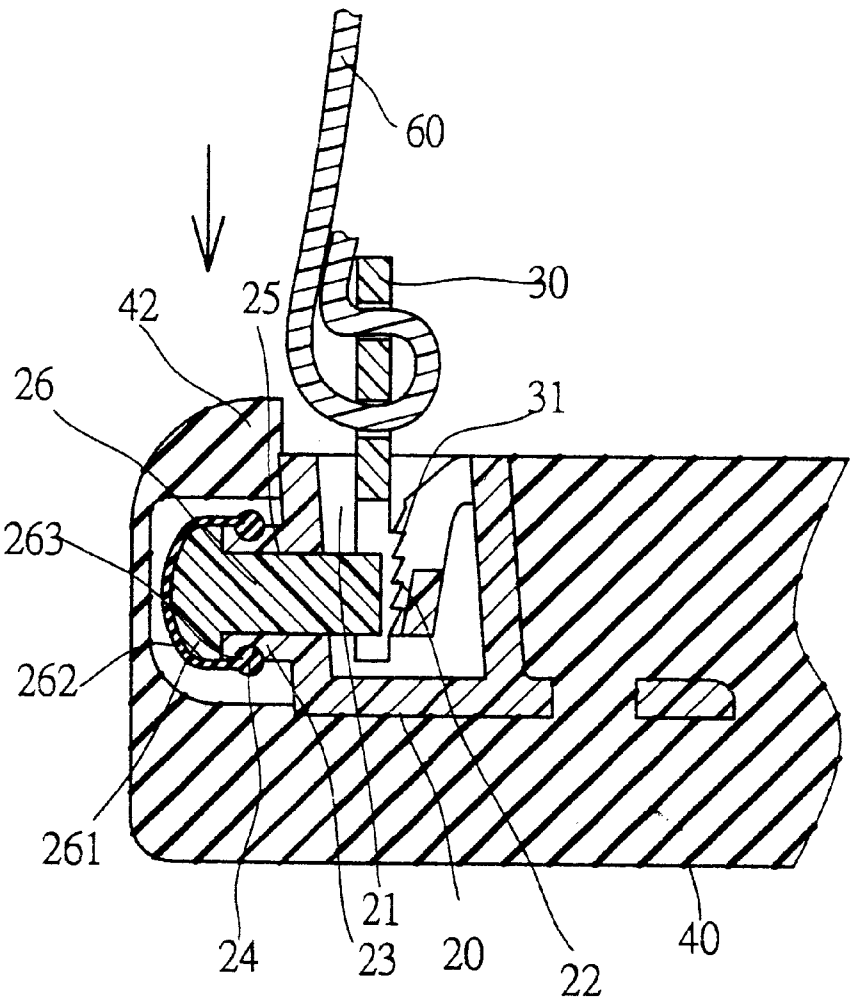
FIG. 6A is a fragmentary cross section of an outsole made by the invention for fastening the vamp.

Referring to FIGS. 3 and 4, the method of manufacturing a hidden shoe with a replaceable vamp and strap according to the invention includes an upper mold and a lower mold coupling together for forming the shoe, and comprising the following steps:

A. fastening a plurality of seal elements 10 to a lower side of the upper mold:

Each seal element 10 has a plate 11 located on an upper side thereof and an insert blade 12 located on a lower side. The insert blade 12 has a gradient on one side. Between the plate 11 and the insert blade 12, there is a rectangular seal block 13 which has the peripheral surface covered by a resilient layer 14. The insert blade 12 may be inserted into a slant insert opening 21 of a female latch member 20 with the rectangular seal block 13 sealing the insert opening 21. Inside the female latch member 20, there is an elastic teeth flap 22 bent normally downwards. The female latch member 20 has an outer wall surface which has a jutting ring 23 formed thereon. The jutting ring 23 has an indented neck 24 formed thereon adjacent to the outer wall of the female latch member 20, and a through bore 25 formed in the center thereof. The through bore 25 houses a latch strut 26 which has an inner end depressing the elastic teeth flap 22 and an outer end formed a cap end 261;

B. preparing an elastic shrouding membrane 262: the elastic shrouding membrane 262 is formed substantially in the shape of a cap with an opening surrounding by an elastic annular trap ring 263. The elastic shrouding membrane 262 may cover the exterior of the cap end 261 with the trap ring 263 tightly gripping the indented neck 24 of the jutting ring 23;

C. filling the lower mold with a foaming material;

D. foaming and blowing process: coupling the upper mold and lower mold to proceed foaming and blowing process to form an outsole 40 in the cavity of the lower mold. The insert openings of the female latch members 20 are exposed to the surface of the outsole 40. The top surface of the outsole 40 further has a plurality of cavities 41 and a sole rim 42 of a selected width formed on the periphery thereof;

E. opening the molds and removing the outsole 40;

F. setting up a vamp 60 and a strap 70: the vamp 60 and strap 70 have respectively a lower side fastened to a male latch member 30. The male latch member 30 has a lower section formed with a teeth section 31 which is engageable with the elastic teeth flap 22 when the male latch member 30 is inserted into the female latch member 20 through the insert opening 21 (as shown in FIG. 6A).

G. setting up an insole 50: the insole 50 has a plurality of insert struts 51 located on a lower side to engage with the cavities 41 formed on the upper surface of the outsole 40.

Figure 5:
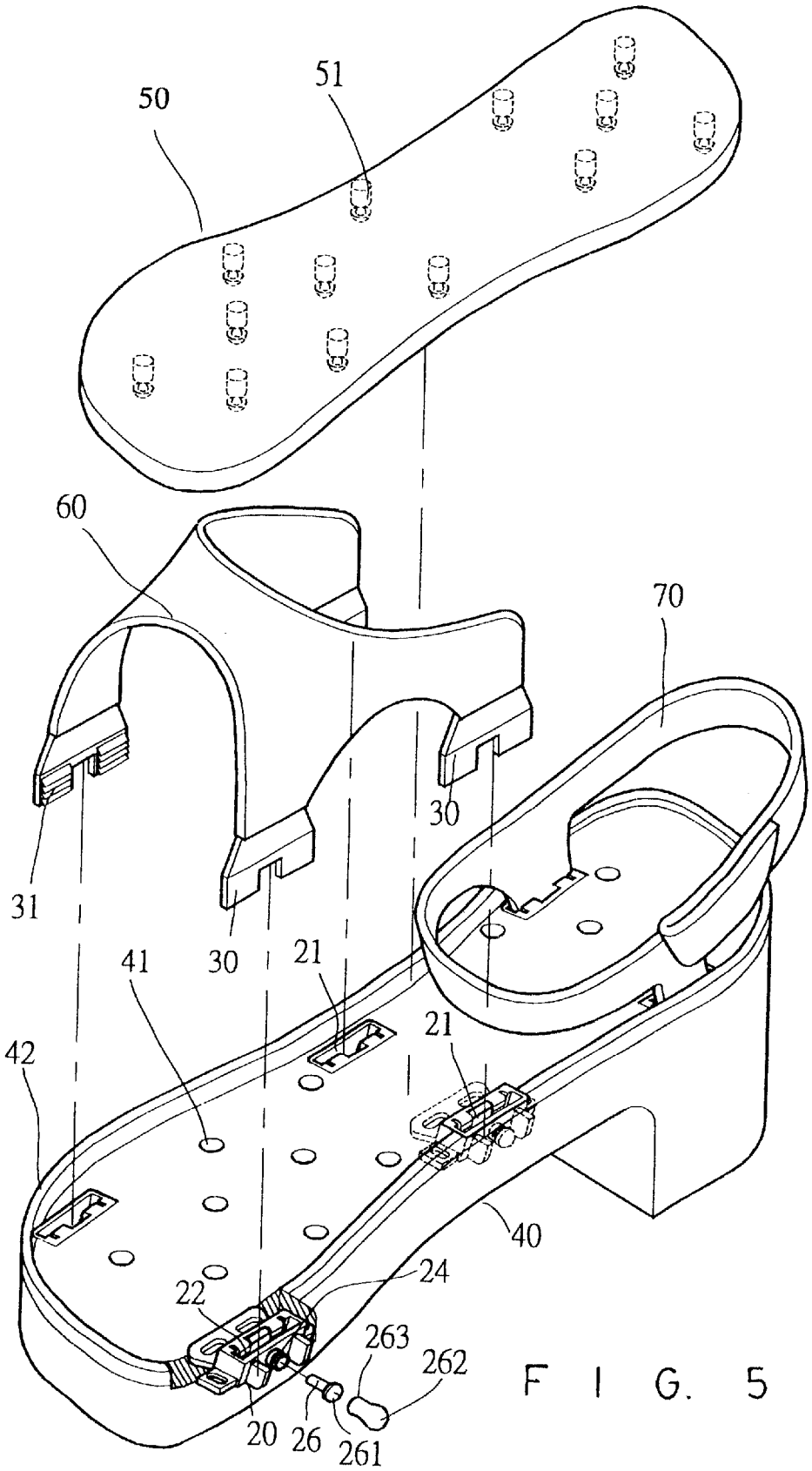
FIG. 5 is an exploded view of a shoe made by the invention.

Through the foregoing manufacturing processes (also referring to FIG. 5), the female latch member 20 has the jutting ring 23 formed on the outer wall surface. The jutting ring 23 has the indented neck 24 adjacent to the outer wall of the female latch member 20 to form a tightly seal engagement with the annular trap ring 263 to allow the elastic shrouding membrane 262 encasing the cap end 261 and the outer end of the latch strut 26. The female latch member 20 then may be disposed on a lower side of the upper mold. The upper mold and the lower mold then may be coupled to proceed foaming process. The foaming material may be prevented from seeping and sticking to the contact surface of the cap end 261 and jutting ring 23 so that the latch strut 26 will be freed from clogging in the outsole 40, and the elastic teeth flap 22 in the female latch member 20 may be moved rearwards under depressing to disengage the male latch member 30.

In addition, after the outsole 40 is formed, the sole rim 42 is integrally formed with the outsole 40. The cavities 41 formed on the surface of the outsole may engage with the insert struts 51 of the insole 50 to save the labor of adhering the insole 50 to the outsole 40 to reduce production cost.

Figure 6B:
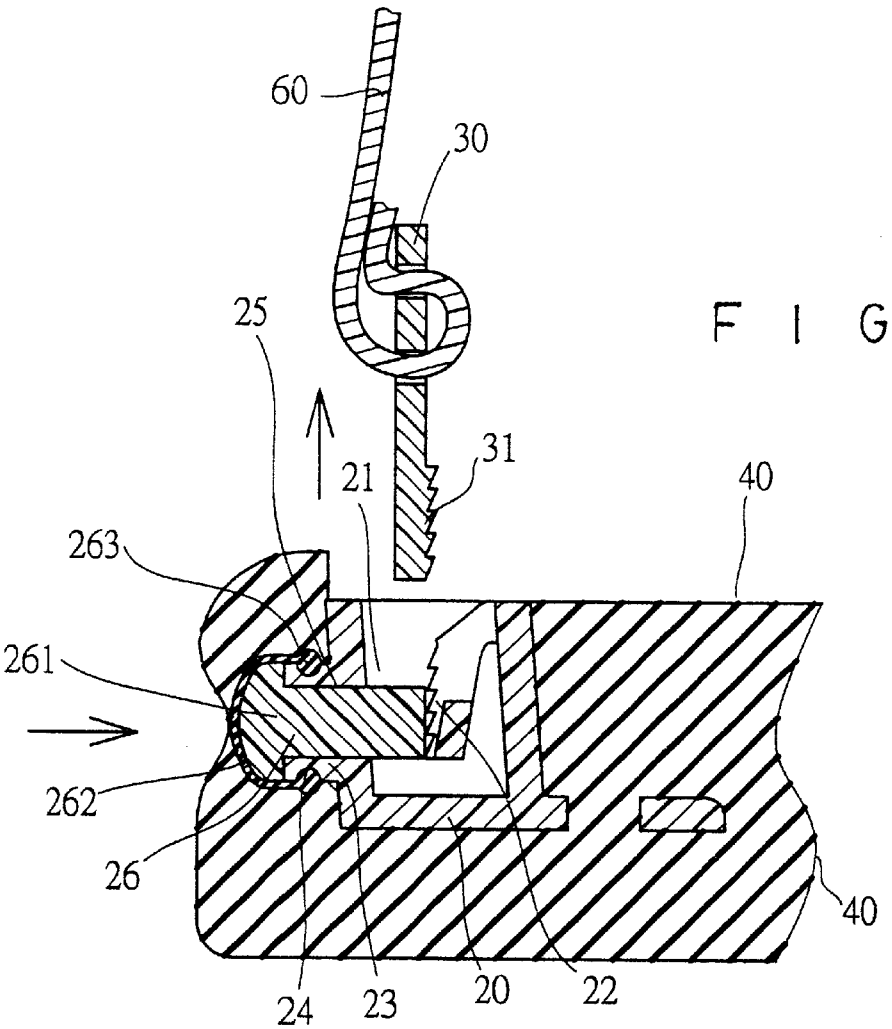
FIG. 6B is a fragmentary cross section of an outsole made by the invention for removing the vamp.

It is to be noted, the periphery of the seal block 13 may also be covered by a resilient layer 14 to allow the seal element 10 bending slightly, thereby when the female latch member 20 is inserted in the lower mold, the female latch member 20 may be pushed close to the side rim of the lower mold for the outsole 40 to form a peripheral skin at a thickness about 1 m/m to surround the female latch member 20. Such a construction may facilitate the depressing of the latch strut 26 when pushing by users' fingers (as shown in FIG. 6B).

The manufacturing method set forth above eliminates the work of bonding the insole 50 to the outsole 40 by human labor through using adhesives. The vamp 60 and strap 70 may be latched easily and positioned precisely in the female latch members 20 through the male latch member 30 by engaging the teeth section 31 with the elastic teeth flap 22. The latch strut 26 may be moved by depressing the outsole 40 on the peripheral side to push the elastic teeth flap 22 inwards for disengaging the teeth section 31 of the male latch member 30 from the female latch member 20 so that the vamp 60 and strap 70 may be replaced easily. The outsole 40 made by the method of the invention further has a smooth peripheral surface and has a greater appealing, and effectively overcomes the disadvantages of unsightly prudent soft cap that happens to the outsoles made by conventional methods.

What is claimed is:

1. A method of manufacturing a hidden type shoe with a replaceable vamp including coupling a foaming upper mold with a foaming lower mold, comprising the steps of:

A. fastening a plurality of seal elements to a lower side of the upper mold, each seal element having a plate located on an upper side thereof and an insert blade located on a lower side thereof, the insert blade having a gradient on one side thereof, the plate and the insert blade being interposed by a rectangular seal block therebetween, the rectangular seal block having a peripheral surface covered by a resilient layer, the insert blade being insertable into a female latch member through a slant insert opening formed in the female latch member such that the rectangular seal block seals the insert opening, the female latch member further having an elastic teeth flap located therein and bent normally downwards, and an outer wall surface which has a jutting ring formed thereon, the jutting ring having an indented neck formed on the peripheral surface thereof and a through bore formed in the center thereof, the through bore housing a latch strut which has an inner end depressing the elastic teeth flap and an outer end formed a cap end;

B. preparing an elastic shrouding membrane formed substantially in the shape of a cap having an opening surrounded by an elastic annular trap ring for tightly gripping the indented neck of the jutting ring to allow the elastic shrouding membrane to cover the cap end;

C. filling the lower mold with a foaming material;

D. coupling the upper mold and the lower mold and proceeding foaming and blowing processes to form an outsole;

E. opening the molds and removing the outsole;

F. setting up a vamp and a strap with a male latch member fastened respectively to a lower end of the vamp and the strap, the male latch member having a teeth section formed on a lower section thereof, the male latch member being insertable into the female latch member through the insert opening to allow the teeth section to engage with the elastic teeth flap of the female latch member; and G. setting up an insole which has a plurality of insert struts located on a lower side thereof to engage with cavities formed on an upper surface of the outsole.

* * * * *